US007558504B2

(12) United States Patent
Jeong et al.

(10) Patent No.: US 7,558,504 B2
(45) Date of Patent: Jul. 7, 2009

(54) IMAGE FORMING APPARATUS

(75) Inventors: Yoo-hung Jeong, Suwon-si (KR); Jai-il Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 261 days.

(21) Appl. No.: 11/439,190

(22) Filed: May 24, 2006

(65) Prior Publication Data

US 2007/0025761 A1 Feb. 1, 2007

(30) Foreign Application Priority Data

Jul. 26, 2005 (KR) ..... 10-2005-0067625

(51) Int. Cl.
*G03G 21/18* (2006.01)

(52) U.S. Cl. ..... 399/111

(58) Field of Classification Search ..... 399/111
See application file for complete search history.

(56) References Cited

U.S. PATENT DOCUMENTS 6,064,843 A 5/2000 Isobe et al.
6,980,756 B2 12/2005 Kubota
2003/0123896 A1* 7/2003 Goto et al. ..... 399/111
2005/0147429 A1* 7/2005 Kim et al. ..... 399/111

FOREIGN PATENT DOCUMENTS

JP 07-311533 11/1995
JP 08-339154 12/1996
JP 2004-125954 4/2004

* cited by examiner

*Primary Examiner*—David M Gray
*Assistant Examiner*—Erika Villaluna
(74) *Attorney, Agent, or Firm*—Stein McEwen, LLP

(57) ABSTRACT

An image forming apparatus includes a developing part having a developing process roller and a position restricting protrusion; a main body having an installation part to install the developing part and a roller driving part driving the developing part; a position restricting groove part to engage the position restricting protrusion so that the developing process roller engages the roller driving part when the developing part is installed; a first rotation supporting part between the installation and developing parts to be positioned at a first position when the developing part is installed to the installation part, and supporting the developing part so that the position restricting protrusion detaches from the position restricting groove part; and a second rotation supporting part between the installation and developing parts to be positioned at a second position and supporting the developing part so that the position restricting protrusion detaches from the position restricting groove part.

17 Claims, 4 Drawing Sheets

IMAGE FORMING APPARATUS

CROSS-REFERENCE TO RELATED APPLICATION

This application claims the benefit of Korean Patent Application No. 2005-67625, filed on Jul. 26, 2005 in the Korean Intellectual Property Office, the disclosure of which is incorporated herein by reference.

BACKGROUND OF THE INVENTION

1. Field of the Invention

Aspects of the present invention relate to an image forming apparatus, and more particularly, to an image forming apparatus in which a developing part is conveniently installed to and removed from a main body.

2. Description of the Related Art

Generally, an image forming method of an image forming apparatus includes an electrophotographic method. In the electrophotographic method, an image is developed by applying developer to an electrostatic latent image formed on a photosensitive element by a potential difference and transferred to a printing paper to be formed. Another image forming method is an inkjet method, where an image is formed by discharging ink onto a printing paper through a multiplicity of inkjet nozzles. An additional image forming method is a dye-sublimation method, where an image is formed by selectively heating an ink ribbon contacted to a printing paper.

Among the methods, the electrophotographic method is widely used in an image forming apparatus because of high printing speed, high resolution and low cost. The electrophotographic type of the image forming apparatus comprises a paper feeding part, an LSU (laser scanning unit), a developing part, a fixing part and a discharging part. When the paper feeding part supplies a printing paper to the developing part and the LSU scans the laser, the developing part selectively applies developer onto the printing paper to form a printed image. The fixing part fixes the applied developer onto the printing paper by applying heat and pressure. The discharging part receives the printing paper with the fixed developer from the developing part and discharges the printing paper to the outside.

The developing part comprises a photosensitive element, a developing roller and a fixing roller. When the LSU scans the laser onto the photosensitive element to form an electrostatic latent image, the developing roller develops an image by supplying the developer to the latent image. The fixing roller transfers the developed image formed on the photosensitive element to the printing paper. Generally, the developing part is provided as a supply which can be installed in and removed from a main body of the image forming apparatus according to such factors as when the developer supply is exhausted, the durability of the developing part, malfunctions, etc.

FIG. 1 is an exploded side view of a conventional image forming apparatus 100. As shown in FIG. 1, the image forming apparatus 100 comprises a developing part 110 and a main body 120. The developing part 110 comprises a plurality of developing process rollers 112, a photosensitive element (not shown) and other items to perform the developing process. The main body 120 comprises an installation part 122 with respect to which the developing part 110 is installed and removed. The developing part 110 is installed in and removed from the installation part 122 in an installing and removing direction A. The installing and removing direction A is perpendicular to an extending direction of the developing process roller 112. The developing part 110 comprises a handling part 170 at one end thereof to be handled by a user.

The installation part 122 comprises a roller driving part 124 disposed to engage with the developing process roller 112 when the developing part 110 is installed at the installation part 122. The roller driving part 124 transfers a driving force to the developing process roller 112, so that the developing part 110 can perform a predetermined developing process.

The installation part 122 comprises a position restricting groove part 126 and the developing part 110 comprises a position restricting protrusion 114. The position restricting groove part 126 extends to have a predetermined length in a predetermined position restricting direction B, which is approximately perpendicular to the installing and removing direction A of the developing part 110. When the developing part 110 is installed at the installation part 122, the position restricting protrusion 114 is held in the position restricting groove part 126, so that the developing process roller 112 can engage with the roller driving part 124.

A pressing member 150 presses the developing part 110 to fix the installing position of the developing part 110 when the developing part 110 is installed at the installation part 122. Accordingly, the developing process roller 112 is prevented from being detached from the roller driving part 124 while the developing part 110 is performing the developing process. An elastic member 152 elastically supports the pressing member 150 to increase the pressure of the pressing member 150 against the developing part 110.

However, according to the conventional image forming apparatus 100 described above, there may be a problem that the developing part 110 is not easily removed from the installation part 122. Since the position restricting direction B is approximately perpendicular to the installing and removing direction A, if the developing part 110 is pressed simply in the installing and removing direction A, the developing part 110 may not be removed because of the engagement of the position restricting groove part 126 with the position restricting protrusion 114. For this reason, the user usually rotates the developing part 110 in a circumferential direction C or D of the developing process roller 112 while the user is holding the handling part 170 and applying force to the developing part 110 in the installing and removing direction A. In this case, the engagement of the position restricting groove part 126 with the position restricting protrusion 114 functions as a rotating pivot of the developing part 110. That is, if the user rotates the developing part 110 in the circumferential direction C or D, the developing part 110 rotates around the position restricting groove part 126 and the position restricting protrusion 114. Even if the user rotates the developing part 110, the position restricting protrusion 114 keeps the engagement with the position restricting groove part 126 only with a different contact angle.

Specifically, the pressing member 150 is disposed to approximately correspond to a position where the position restricting protrusion 114 engages with the position restricting groove part 126, so that the pressing member 150 presses the developing part 110 in a direction E. Accordingly, the pressure of the pressing member 150 prevents the position restricting protrusion 114 from detaching from the position restricting groove part 126 and may cause more inconvenience to the user in removing the developing part 110 from the installation part 122.

SUMMARY OF THE INVENTION

Aspects of the present invention provide an image forming apparatus in which a developing part is conveniently removed from a main body.

Additional aspects and/or advantages of the present invention will be set forth in part in the description which follows and, in part, will be obvious from the description, or may be learned by practice of the present invention.

According to an aspect of the invention, an image forming apparatus comprises a developing part having a developing process roller to perform a developing process and formed with a position restricting protrusion; a main body having an installation part with respect to which the developing part is detachably installed along a predetermined installing/removing path and a roller driving part for driving the developing process roller; a position restricting groove part formed on a predetermined restricting position of the installation part to engage with the position restricting protrusion so that the developing process roller engages the roller driving part when the developing part is installed; a first rotation supporting part interposed between the installation part and the developing part to be positioned at a first position which is at least in front of the restricting position in an installing direction along which the developing part is installed to the main body in an installation state when the developing part is installed to the installation part, and supporting the developing part to rotate around the first position when the developing part is rotated along a first circumferential direction of the developing process roller, so that the position restricting protrusion detaches from the position restricting groove part; and a second rotation supporting part interposed between the installation part and the developing part to be positioned at a second position which is at least in front of the restricting position in the opposite direction of the installing direction in the installation state, and supporting the developing part to rotate around the second position when the developing part is rotated along a second circumferential direction which is opposite of the first circumferential direction, so that the position restricting protrusion detaches from the position restricting groove part.

According to another embodiment of the present invention, each of the first rotation supporting part and the second rotation supporting part comprises a protruding part extending from the installation part by a predetermined length.

According to another embodiment of the present invention, the developing part comprises contacting parts formed to correspond to the first rotation supporting part and the second rotation supporting part respectively.

According to another embodiment of the present invention, the installation part comprises a pressing member pressing the developing part for the position restricting protrusion to be engaged with the position restricting groove part at a predetermined pressing position which corresponds to the restricting position in the installation state.

According to another embodiment of the present invention, the installation part comprises an elastic member supporting the pressing member.

BRIEF DESCRIPTION OF THE DRAWINGS

The above and/or other aspects and advantages of the present invention will become apparent and more readily appreciated from the following description of the embodiments, taken in conjunction with the accompanying drawings of which.

DETAILED DESCRIPTION OF THE EMBODIMENTS

Figure 1:
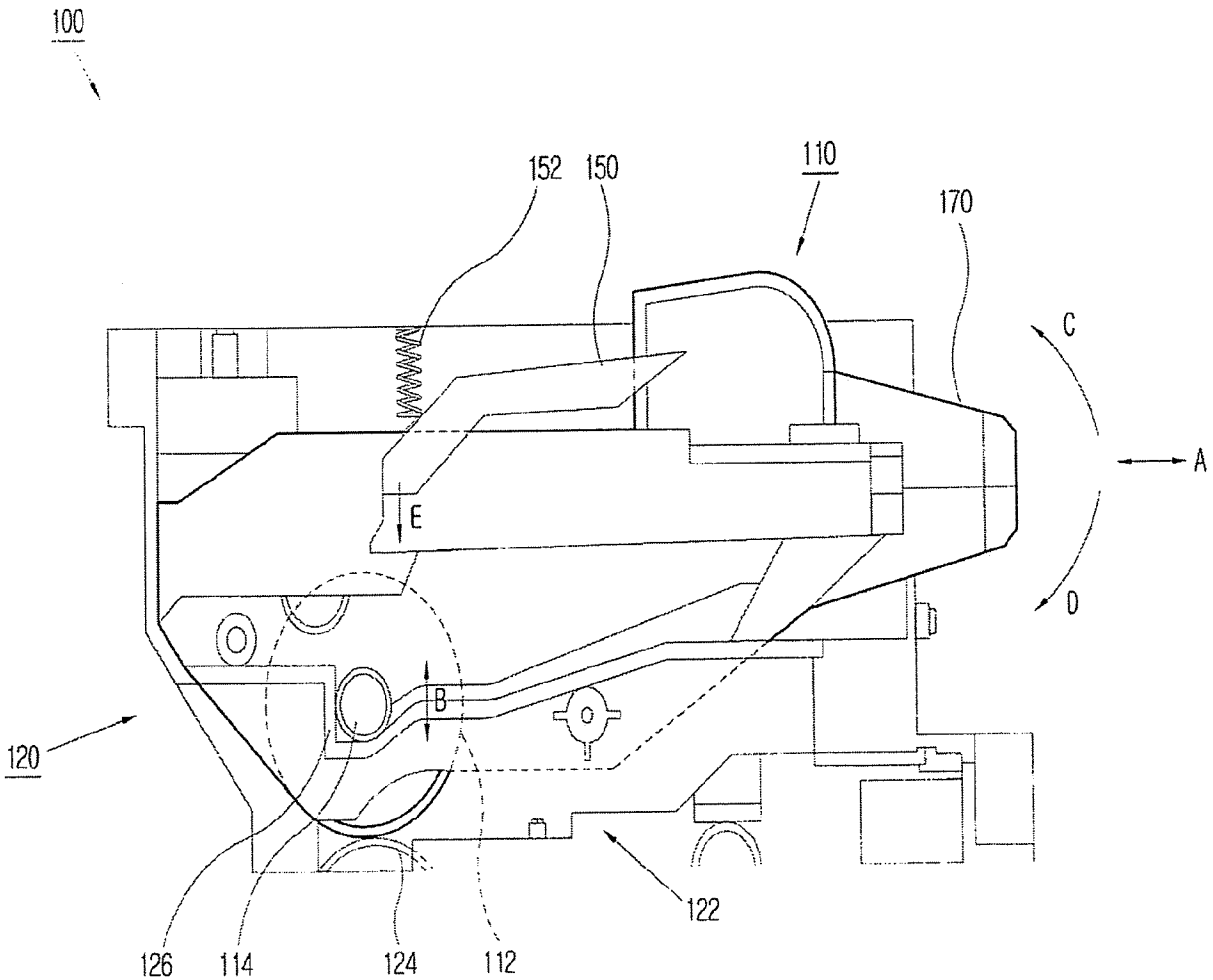
FIG. 1 (Related Art)
FIG. 1 is an exploded side view of a conventional image forming apparatus.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 2:
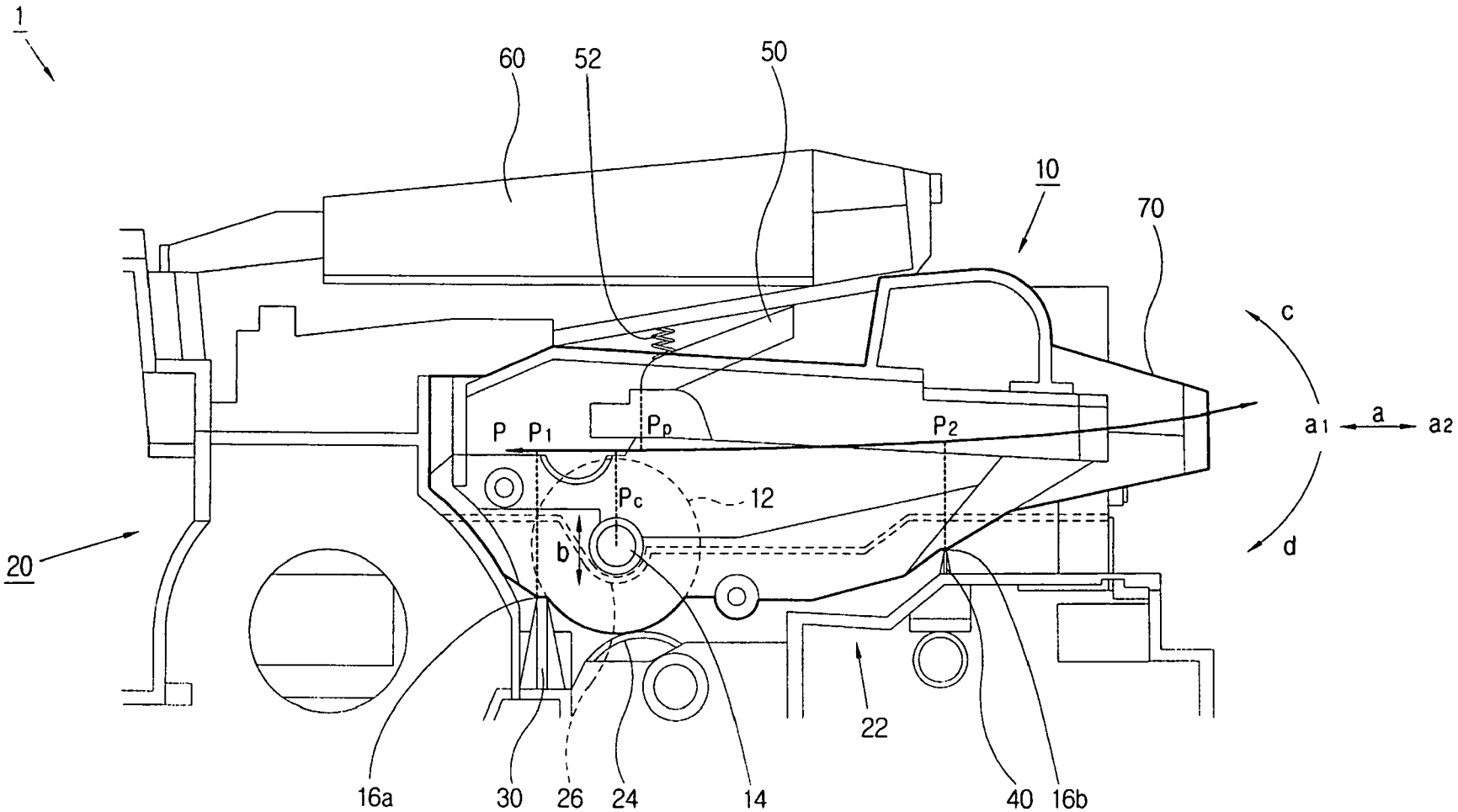
FIG. 2 is an exploded side view of an image forming apparatus according to an embodiment of the present invention.

FIG. 2 is an exploded side view of an image forming apparatus according to an embodiment of the present invention. As shown in FIG. 2, an image forming apparatus 1 comprises a developing part 10, a main body 20 and a scanning unit 60. The developing part 10 comprises a developing process roller 12 to perform a developing process. The main body 20 comprises an installation part 22. The developing part 10 is detachably installed to the installation part 22. The scanning unit 60 may be provided at the main body 20 or at the developing part 10, but is shown provided at the main body 20. The scanning unit 60 comprises a light source such as a laser diode and an LED (light emitting diode) to scan a ray of light at a photosensitive element (not shown) to provide a latent image. The developing process roller 12 develops an image by supplying the developer to the latent image in order to transfer the developed image formed on the photosensitive element to the printing paper or other media.

While not required in all aspects, the image forming apparatus 1 may further comprise a paper feeding part to supply a printing paper, a fixing part -to fix developer applied to the printing paper, and/or a discharging part (not shown) to discharge the printing paper to the outside according to aspects of the invention. The image forming apparatus 1 may be a printer, a copy machine, a facsimile, a multi-function printer or the like according to aspects of the invention.

The developing process roller 12 performs the predetermined developing process in cooperation with the main body 20 when the developing part 10 is installed in the installation part 22. The developing process roller 12 further includes a position restricting protrusion 14. The position restricting protrusion 14 protrudes to the outside of the developing part 10 along an extending direction of the developing process roller 12 in order to be held in a position restricting groove part 26 when the developing part 10 is installed at the installation part 22. The developing part 10 comprises a handling part 70 to be handled by a user. Alternately, the position restricting protrusion 14 may protrude along a direction other than the extending direction, and the developing part 100 need not include the handling part 70 according to aspects of the invention.

While not required in all aspects, the developing process roller 12 may comprise the photosensitive element exposed to the scanning unit 60 to form an electrostatic latent image, a developing roller developing an image by supplying developer to the latent image, a supplying roller supplying the developer to the developing roller and/or a charging roller making uniform voltage over the photosensitive element.

The main body 20 comprises the installation part 22 at which the developing part 10 is detachably installed. The developing part 10 is installed and removed relative to the installation part 22 along a predetermined installing/removing path P. The developing part 10 is installed to and removed from the installation part 22 along the installing/removing path P. The path P is perpendicular to the extending direction of the developing process roller 12. The developing part 10 may be installed or removed for multiple reasons, such as the exhaustion of the developer, malfunction of the developer and/or paper jams, maintenance of the image forming apparatus 1, and other reasons. The developing part 10 may alternately be installed to and removed along an installing/removing path P in the extending direction of the developing process roller 12 or along an installing/removing path other than the installing/removing path P as shown in FIG. 2.

A roller driving part 24 is disposed at the installation part 22 for driving the developing process roller 12. The roller driving part 24 is disposed at the installation part 22 and engages the developing process roller 12 to supply a driving force when the developing part 10 is installed to the installation part 22. The roller driving part 24 may optionally engage with the developing process roller 12 by other transmission mechanisms, such as by gearing, belting or other like connecting devices.

The position restricting groove part 26 is formed in a restricting position Pc of the installation part 22, and holds the position restricting protrusion 14 to make the developing roller 12 engage with the roller driving part 24 when the developing part 10 is installed at the installation part 22. The position restricting groove part 26 is positioned at the restricting position Pc in the installing/removing path P and extends in a position restricting direction b which is substantially perpendicular to a direction (i.e., the installing and removing direction a) in which the developing part 10 is installed and removed along the installing/removing path P. When the developing part 10 is installed at the installation part 22 along the installing/removing path P, the position restricting groove part 26 restricts the installing position of the developing part 10 by moving the developing part 10 in the position restricting direction b. Accordingly, the developing process roller 12 stably engages with the roller driving part 24, so that the developing part 10 smoothly performs a developing process. While described as a position restricting groove part 26, it is understood that other mechanisms can interact with elements of the developing part 10 to hold the developing part 10 at the restricting position Pc.

If the main body 20 further comprises a transfer roller (not shown) to transfer developer applied to the photosensitive element to a printing paper, the engagement between the position restricting groove part 26 and the position restricting protrusion 14 may place the developing part 10 for the photosensitive element to smoothly cooperate with the transfer roller.

As shown, the groove part 26 extends in a direction having a predetermined angle with the installing/removing direction a and a predetermined angle with the position restricting direction b. However, it is understood that, as long as the position restricting groove part 26 restricts the installing position of the developing part 10, the groove part 26 may extend in the direction having the predetermined angle with the installing/removing direction a or in any direction other than the position restricting direction b. However, it is understood that the groove part 26 need not be at such an angle relative to direction b in all aspects.

The main body 20 may optionally comprise a cover (not shown) in the installing/removing path of the developing part 10 in order to enable the installation part 22 to be accessed from the outside. Also, the main body 20 may optionally comprise a guide part (not shown) to guide the developing part 10 installing or removing along the installing/removing path P when the developing part 10 is installed to or removed from the installation part 22. The guide part (not shown) may be conventional guiding mechanism, such as a rail or track.

Figure 3A:
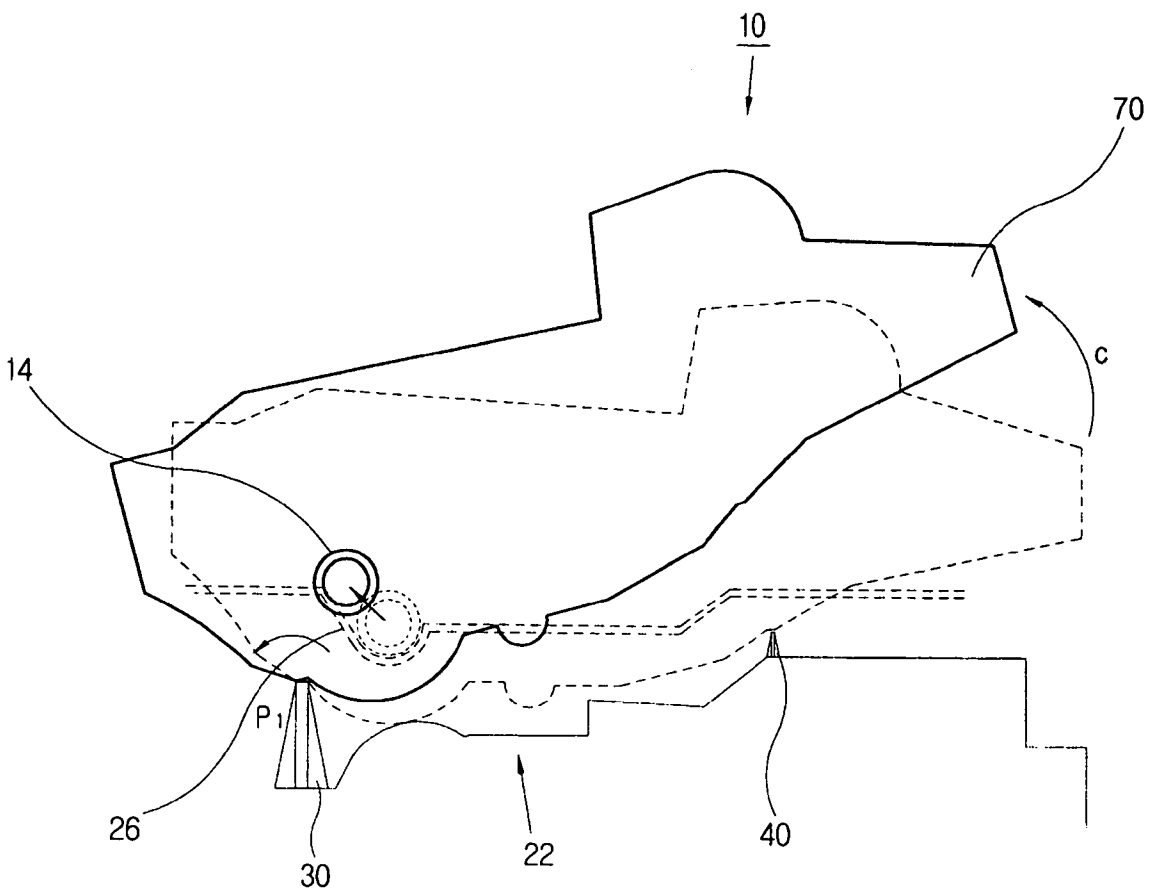
FIGS. 3A and 3B are schematic side views of the image forming apparatus in FIG. 2 in operations.

The first rotation supporting part 30 is interposed between the installation part 22 and the developing part 10 to be positioned at a first position P1. The first position P1 is at least in front of the restricting position Pc in the installing direction a1 along which the developing part 10 is installed into the main body 20. The first rotation part 30 supports the developing part 10, to allow the developing part 10 to rotate around the first position P1, when the developing part 10 is rotated along a first circumferential direction c of the developing process roller 12, so that the position restricting protrusion 14 parts from the position restricting groove part 26 as shown in FIG. 3A. In other words, the position restricting groove part 26 includes a ramp that is angled away from the restricting position Pc, and the position restricting protrusion 14 slides up the ramp, while the developing part 10 rotates along the first circumferential direction c.

The first rotation supporting part 30 is positioned at the first position P1 which is in front of the restricting position Pc, at which the position restricting groove part 26 is positioned, in the installing direction a1. The first rotation supporting part 30 comprises a projection which is extended for a predetermined length to direct from the installation part 22 to the developing part 10 as shown. Alternately, the first rotation supporting part 30 may be multiple projections or a ridge at the first position P1 of the installation part 22 along the extending direction of the developing process roller 12. The first rotation supporting part 30 is shown to be in contact with the developing part 10 if the developing part 10 is installed in the installation part 22, but alternately may be extended to be in contact with the developing part 10 if the developing part 10 rotates around the developing process roller 12. Alternatively, the first rotation supporting part 30 may be extended to be in contact with the developing part 10 if the developing part 10 is installed in the installation part 22.

When the user presses the handling part 70 upwardly to remove the developing part 10 and rotates the developing part 10 in the first circumferential direction c around the developing process roller 12, the first rotation supporting part 30 contacts the developing part 10 and makes the developing part 10 rotate around the first position P1. Accordingly, the first rotation supporting part 30 prevents the developing part 10 from rotating around the restricting position Pc and allows the position restricting protrusion 14 to be removed from the position restricting groove part 26.

The shown first rotation supporting part 30 described herein is provided in the installation part 22. However, the first rotation supporting part 30 may protrude from the developing part 10 or protrude from both the developing part 10 and the installation part 22 respectively as long as it is interposed between the installation part 22 and the developing part 10 to support the developing part 10 at the first position P1 according to an aspect of the invention.

Figure 3B:
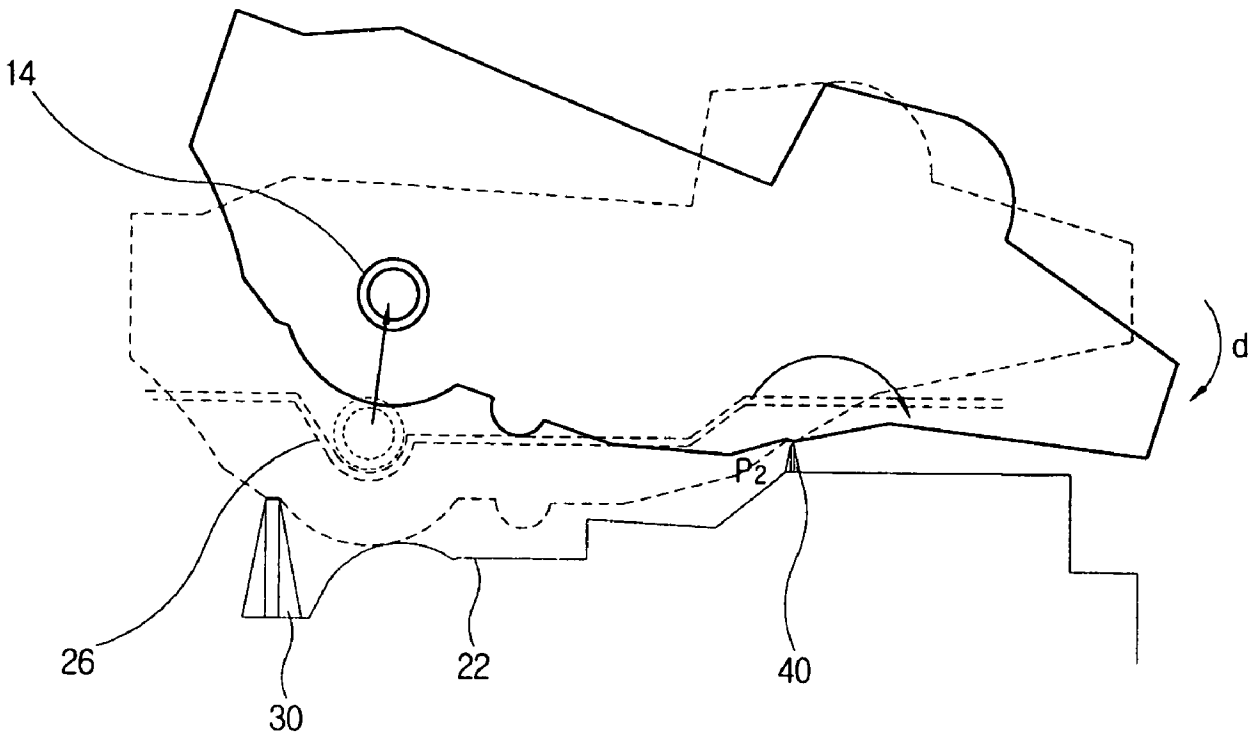

The second rotation supporting part 40 is interposed between the installation part 22 and the developing part 10 at a second position P2. The second position P2 is in front of the restricting position Pc in the opposite direction a2 of the installing direction in the installation state of the developing part 10 such that the position Pc is between the positions P1 and P2. The second rotation supporting part 40 supports the developing part 10 to rotate around the second position P2 when the developing part 10 is rotated along a second circumferential direction d which is opposite of the first circumferential direction c, so that the position restricting protrusion 14 detaches from the position restricting groove part 26 as shown in FIG. 3B.

Like the first rotation supporting part 30, the second rotation supporting part 40 is shown to protrude from the installation part 22. Alternately, the part 22 may also be provided as multiple protrusions or a ridge along the extending direction of the developing process roller 12. The second rotation supporting part 40 alternately may be provided in the developing part 10 or in both the developing part 10 and the installation part 22 respectively.

When the user presses the handling part 70 downwardly and rotates the developing part 10 in the second circumferential direction d, which is opposite to the first circumferential direction c, around the developing process roller 12, the second rotation supporting part 40 contacts the developing part 10 and makes the developing part 10 rotate around the second position P2. Accordingly, the second rotation supporting part 40 also prevents the developing part 10 from rotating around the restricting position Pc and allows the position restricting protrusion 14 to detach from the position restricting groove part 26.

While shown as having first and second rotation parts 30, 40, it is understood that a single axis of rotation can be used such that both rotation parts 30 and 40 are not required in all aspects of the invention. Moreover, it is understood that additional rotation parts can be used and otherwise located so long as the axis of rotation is induced about a part which allows the position restricting protrusion 14 to detach from the position restricting groove part 26, where the axis is other than at the restricting position Pc. For instance, it would be possible to have structural elements that induce such an axis in other locations, such as above or to the side of the developing part 10 instead of below the developing part 10 as shown. Moreover, it is understood that one or both of the first and second rotation parts 30, 40 can be retractable and need not be protruding except when the developing part 10 is being removed.

While not required in all aspects, the developing part 10 has contacting parts 16*a* and 16*b* formed in positions to correspond to and contact the first rotation supporting part 30 and the second rotation supporting part 40 respectively. The contacting parts 16*a* and 16*b* prevent the first rotation supporting part 30 and the second rotation supporting part 40 from detaching when the developing part 10 is rotated and rotatably supported by the first rotation supporting part 30 and the second rotation supporting part 40. The contacting parts 16*a* and 16*b* may be formed to correspond to configurations of the first rotation supporting part 30 and the second rotation supporting part 40 respectively. Also, the contacting part 16 may be made of material having a high coefficient of friction. Alternately, the parts 16*a* and 16*b* may be included on the rotation supporting parts 30, 40 instead of or in addition to the developing part 10, or may be included on the main body 20 such as when the rotation supporting parts 30, 40 are disposed on the developing part 10.

The installation part 22 comprises a pressing member 50. When the developing part 10 is fully installed at the installation part 22, the pressing member 50 presses the developing part 10 at a pressing position Pp corresponding to the restricting position Pc for the position restricting protrusion 14 to be held in the position restricting groove part 26. The pressing member 50 presses the developing part 10 installed in the installation part 22 to prevent the position restricting protrusion 14 from detaching from the position restricting groove part 26. Accordingly, the pressing member 50 fixes the installation position of the developing part 10, so that the developing part 10 stably engages with the main body 20 to perform a predetermined developing process.

In the image forming apparatus 1, when the developing part 10 is removed, the developing part 10 does not rotate around the restricting position Pc but around the first position P1 or the second position P2. Accordingly, even if the pressing member 50 has the pressing position Pp to correspond to the restricting position Pc, the position restricting protrusion 14 may be easily removed from the position restricting groove part 26 when the developing part 10 is removed. Accordingly, the image forming apparatus 1 comprises the pressing member 50 of which the pressing position Pp corresponds to the restricting position Pc, so that the developing part 10 may be stably installed in the installation part 22 and may be easily removed from the installation part 22.

The installation part 22 includes an elastic member 52 to support the pressing member 50, but need not include such a biasing member in all aspects. The elastic member 52 elastically supports the pressing member 50 to enhance the pressure which the pressing member 50 applies to the developing part 10. The elastic member 52 may comprises an elastic spring such as a coil spring and a plate spring.

Hereinafter, an operation of the image forming apparatus according to the present invention will be described with reference to FIGS. 2, 3A and 3B. FIG. 3A is a schematic side view of the image forming apparatus in FIG. 2 when the developing part 10 rotates in the first circumferential direction c. FIG. 3B is a schematic side view of the image forming apparatus in FIG. 2 when the developing part 10 rotates in the second circumferential direction d. As shown in FIG. 3A, when the user rotates the developing part 10 in the first circumferential direction c by pressing the holding part 70 upwardly to remove the developing part 10 from the installation part 22, the developing part 10 rotates around the restricting position Pc where the position restricting protrusion 14 is held in the position restricting groove part 26 until the developing part 10 contacts to the first rotation supporting part 30. Then, a rotation shaft of the developing part 10 is shifted from the restricting position Pc to the first position P1. Accordingly, the developing part 10 is supported by the first rotation supporting part 30 and rotates around the first rotation supporting part 30. As the developing part 10 continues rotating, the position restricting protrusion 14 detaches from the position restricting groove part 26. Then, if the user presses the holding part 70 in the removing direction a2, the developing part 10 may easily be removed from the installation part 22 along the installing/removing path P.

Meanwhile, as shown in FIG. 3B, when the user rotates the developing part 10 in the second circumferential direction d by pressing the holding part 70 downwardly to remove the developing part 10 from the installation part 22, the developing part 10 rotates around the restricting position Pc until the developing part 10 contacts the second rotation supporting part 40. Then, the rotation shaft of the developing part 10 is shifted from the restricting position Pc to the second position P2. Accordingly, the developing part 10 rotates around the second rotation supporting part 40. As the developing part 10 continues rotating, the position restricting protrusion 14 detaches from the position restricting groove part 26. Then, if the user presses the holding part 70 in the removing direction a2, the developing part may easily be removed from the installation part 22 along the installing/removing path P. Thus, the image forming apparatus 1 has a position restricting protrusion 14 which can be easily removed from the position restricting groove part 26 if the user rotates the developing part 10 in any circumferential direction, so that the user can easily remove the developing part 10 from the installation part 22.

Even if the pressing member 50 presses the developing part 10 at the pressing position Pp corresponding to the restricting position Pc, as the developing part 10 rotates around the first position P1 or the second position P2, the position restricting protrusion 14 may easily detach from the position restricting groove part 26 by the rotational force of the developing part 10 which rotates around the first position P1 or the second position P2. Particularly, if the position of the first rotation supporting part 30 or the second rotation supporting part 40 is properly adjusted, even a small amount of the user's pressure can overcome the pressure of the pressing member 50 by leverage effect. While shown as having two pivots to provide such a leverage effect, it is understood that only a single such point need be used to allow single direction rotation (i.e., in direction c or d).

Though the embodiment described above is for an image forming apparatus using dry developer, the image forming apparatus according to the present invention may be an image forming apparatus using wet developer or other image forming apparatus as long as it has a developing part which is inserted to or removed from a main body.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An image forming apparatus comprising:

a developing part having a developing process roller to perform a developing process and a position restricting protrusion;

a main body having an installation part at which the developing part is detachably installed and a roller driving part for driving the developing process roller;

a position restricting groove part formed on a predetermined restricting position of the installation part, to engage the position restricting protrusion, so that the developing process roller engages the roller driving part, when the developing part is installed at the installation part;

a first rotation supporting part between the installation part and the developing part, at a first position other than the restricting position, and which supports the developing part to rotate around the first position, when the developing part is rotated along a first circumferential direction of the developing process roller, so that the position restricting protrusion detaches from the position restricting groove part; and a second rotation supporting part between the installation part and the developing part, at a second position, such that the restricting position is between the first and second positions, the second rotation supporting part supporting the developing part to rotate around the second position, when the developing part is rotated along a second circumferential direction other than the first circumferential direction, so that the position restricting protrusion detaches from the position restricting groove part.

2. The image forming apparatus according to claim 1, wherein each of the first rotation supporting part and the second rotation supporting part comprises a protruding part extending from the installation part, by a predetermined length.

3. The image forming apparatus according to claim 2, wherein the developing part comprises contacting parts, which contact the first rotation supporting part and the second rotation supporting part, respectively.

4. The image forming apparatus according to claim 3, wherein the installation part further comprises a pressing member pressing the developing part at a predetermined pressing position, such that the position restricting protrusion is engaged with the position restricting groove part, and the predetermined pressing position corresponds to the restricting position, when the developing part is installed at the installation part.

5. The image forming apparatus according to claim 4, wherein the installation part further comprises an elastic member supporting the pressing member, to bias the developing part against the position restricting groove.

6. The image forming apparatus according to claim 2, wherein the installation part further comprises a pressing member pressing the developing part at a predetermined pressing position, such that the position restricting protrusion is engaged with the position restricting groove part, and the predetermined pressing position corresponds to the restricting position, when the developing part is installed at the installation part.

7. The image forming apparatus according to claim 6, wherein the installation part further comprises an elastic member supporting the pressing member, to bias the developing part against the position restricting groove.

8. The image forming apparatus according to claim 1, wherein the installation part further comprises a pressing member pressing the developing part at a predetermined pressing position, such that the position restricting protrusion is engaged with the position restricting groove part, and the predetermined pressing position corresponds to the restricting position, when the developing part is installed at the installation part.

9. The image forming apparatus according to claim 8, wherein the installation part further comprises an elastic member supporting the pressing member, to bias the developing part against the position restricting groove.

10. An image forming apparatus comprising:

a developing part having a developing process roller to perform a developing process;

a main body having a roller driving part for driving the developing process roller and an installation part having a position restricting part to hold the developing process roller at a restricting position, so that the developing process roller engages the roller driving part, when the developing part is installed at the installation part;

a first rotation supporting part disposed at a position other than the restricting position and which, when the developing part is rotated, induces an axis of rotation of the developing part not including the restricting position, such that the developing process roller is lifted from the restricting position; and a second rotation supporting part disposed at another position, which is at a distance from the restricting position sufficient to induce another rotation of the developing part, to detach the developing process roller from the restricting position about another axis of rotation not including the restricting position, wherein the restricting position is between the first rotation supporting part and the second rotation supporting part.

11. The image forming apparatus of claim 10, wherein:

the position restricting part comprises a position restricting groove defining the position restricting position, the developing part further includes a position restricting protrusion, which is inserted into the groove to hold the position restricting protrusion at the restricting position, so that the developing process roller engages the roller, and the first rotation supporting part is not in the position restrictive groove.

12. The image forming apparatus of claim 10, wherein the first rotation supporting part comprises a member protruding from the main body to contact the developing part at the position.

13. The image forming apparatus of claim 12, wherein the developing part comprises a contacting member having a high coefficient of friction, which interacts with the member protruding from the main body to define the axis of rotation.

14. The image forming apparatus of claim 10, wherein the first rotation supporting part comprises a member protruding from the developing part to contact the main body at the position.

15. An image forming apparatus comprising:

a developing part having a developing process roller to perform a developing process;

a main body having a roller driving part for driving the developing process roller and an installation part having a position restricting part to hold the developing process roller at a restricting position, so that the developing process roller engages the roller driving part when the developing part is installed at the installation part; and a rotation supporting part disposed at a position other than the restricting position and which, when the developing part is rotated, induces an axis of rotation of the developing part not including the restricting position such that the developing process roller is lifted from the restricting position, wherein, the position restricting part comprises a position restricting groove defining the position restricting position, the developing part further includes a position restricting protrusion that is inserted into the groove, to hold the position restricting protrusion at the restricting position, so that the developing process roller engages the roller, the rotation supporting part is not in the position restrictive groove, the position restricting groove further includes a ramp angled away from the position restricting position, toward the rotation supporting part, and when the developing part is rotated, the position restricting protrusion slides up the ramp, while rotating about the induced axis of rotation.

16. An image forming apparatus comprising;

a developing part having a developing process roller to perform a developing process;

a main body having a roller driving part for driving the developing process roller and an installation part having a position restricting part to hold the developing process roller at a restricting position, so that the developing process roller engages the roller driving part, when the developing part is installed at the installation part;

a rotation supporting part disposed at a position other than the restricting position and which, when the developing part is rotated, induces an axis of rotation of the developing part not including the restricting position, such that the developing process roller is lifted from the restricting position; and a biasing member, which biases the developing part to remain at the restricting position, so that the developing process roller engages the roller driving part, when the developing part is installed at the installation part.

17. An image forming apparatus comprising:

a developing part having a developing process roller to perform a developing process;

a main body having a roller driving part for driving the developing process roller and an installation part having a position restricting part to hold the developing process roller at a restricting position, so that the developing process roller engages the roller driving part, when the developing part is installed at the installation part, wherein, the position restricting part comprises a position restricting groove defining the position restricting position, and the developing part further includes a position restricting protrusion that is inserted into the groove, to hold the position restricting protrusion at the restricting position, so that the developing process roller engages the roller;

a rotation supporting part disposed at a position other than the restricting position and which, when the developing part is rotated, induces an axis of rotation of the developing part not including the restricting position, such that the developing process roller is lifted from the restricting position, wherein, the rotation supporting part is not in the position restrictive groove, the position restricting groove further includes a ramp angled away from the position restricting position, towards the rotation supporting part, and when the developing part is rotated, the position restricting protrusion slides up the ramp toward the rotation supporting part, while rotating about the induced axis of rotation; and a biasing member, which biases the position restricting protrusion in a first direction to remain at the restricting position, so that the developing process roller engages the roller driving part when the developing part is installed at the installation part, wherein the ramp is angled away from the position restricting position toward the rotation supporting part, in a second direction other than the first direction.

* * * * *